US010784614B2

(12) United States Patent
Kong et al.

(10) Patent No.: US 10,784,614 B2
(45) Date of Patent: Sep. 22, 2020

(54) ELECTRICAL CONNECTOR HAVING A FASTENER

(71) Applicant: ALLTOP ELECTRONICS (SUZHOU) LTD., Suzhou, Jiangsu Province (CN)

(72) Inventors: Dewen Kong, Suzhou (CN); Zhiqiang Rong, Suzhou (CN); Yajuan Gou, Suzhou (CN)

(73) Assignee: ALLTOP ELECTRONICS (SUZHOU) LTD., Suzhou, Jiangsu Province (CN)

( * ) Notice: Subject to any disclaimer, the term of this patent is extended or adjusted under 35 U.S.C. 154(b) by 0 days.

(21) Appl. No.: 16/537,455

(22) Filed: Aug. 9, 2019

(65) Prior Publication Data

US 2020/0059029 A1 Feb. 20, 2020

(30) Foreign Application Priority Data

Aug. 17, 2018 (CN) ..... 2018 1 0942914

(51) Int. Cl.

| | |
|---|---|
| ***H01R 13/42*** | (2006.01) |
| ***H01R 13/424*** | (2006.01) |
| ***H01R 4/18*** | (2006.01) |
| ***H01R 13/432*** | (2006.01) |

(52) U.S. Cl.

CPC ..... *H01R 13/424* (2013.01); *H01R 4/185* (2013.01); *H01R 13/432* (2013.01)

(58) Field of Classification Search

CPC ..... H01R 13/624; H01R 4/185; H01R 13/432

USPC ..... 439/746

See application file for complete search history.

(56) References Cited

U.S. PATENT DOCUMENTS

| | | | | | |
|---|---|---|---|---|---|
| 4,804,341 | A * | 2/1989 | Kato | H01R 13/4361 | 439/733.1 |
| 5,066,252 | A * | 11/1991 | Kato | H01R 13/4362 | 439/595 |
| 5,108,319 | A * | 4/1992 | Tsuji | H01R 13/4368 | 439/595 |
| 5,160,283 | A * | 11/1992 | Fry | H01R 13/4362 | 439/752 |
| 5,203,722 | A * | 4/1993 | Kinoshita | H01R 13/4362 | 439/595 |
| 5,224,883 | A * | 7/1993 | Yamamoto | H01R 13/4368 | 439/595 |

(Continued)

*Primary Examiner* — Alexander Gilman
(74) *Attorney, Agent, or Firm* — Cheng-Ju Chiang

(57) ABSTRACT

An electrical connector includes an insulative housing, a plurality of contacts, and a fastener. The insulative housing has a plurality of contact-receiving passageways and a positioning slot recessed upwards from a bottom face thereof, the positioning slot is communicated with the contact-receiving passageways. The fastener is assembled into the positioning slot before the contacts being inserted into the insulative housing. Each contact defines a stopping portion and an elastic locking arm, the locking arm extends backwards to form a free end, and the free ends of the locking arms are locking with the insulative housing to realize a pre-position between the contacts and the housing, after the contacts assembled into the insulative housing, the fastener is pressed upwards into the positioning slot fully and abutting against a rear end of the stopping portion to form a secondary positioning.

15 Claims, 9 Drawing Sheets

(56) References Cited

U.S. PATENT DOCUMENTS

| | | | | | |
|---|---|---|---|---|---|
| 5,299,958 | A * | 4/1994 | Ohsumi | H01R 13/4362 | 439/752 |
| 5,326,287 | A * | 7/1994 | Hamakita | H01R 13/4362 | 439/595 |
| 5,342,221 | A * | 8/1994 | Peterson | H01R 13/514 | 439/677 |
| 5,358,427 | A * | 10/1994 | Miwa | H01R 13/4362 | 439/595 |
| 5,595,509 | A * | 1/1997 | Fry | H01R 13/4362 | 439/595 |
| 5,711,687 | A * | 1/1998 | Kuiper-Moore | H01R 13/434 | 439/745 |
| 5,741,162 | A * | 4/1998 | Kourimsky | H01R 13/432 | 439/746 |
| 5,954,545 | A * | 9/1999 | Lehner | H01R 13/432 | 439/746 |
| 6,676,453 | B1 * | 1/2004 | Rosset Rubio | H01R 13/4362 | 439/752 |
| 7,462,067 | B1 * | 12/2008 | Whiteman, Jr. | H01R 13/743 | 439/562 |
| 9,437,947 | B2 * | 9/2016 | Johnescu | H01R 12/7047 | |
| 9,793,640 | B1 * | 10/2017 | Choo | H01R 24/20 | |
| 10,566,738 | B2 * | 2/2020 | Hung | H01R 13/62955 | |

* cited by examiner

ELECTRICAL CONNECTOR HAVING A FASTENER

CROSS REFERENCE TO RELATED APPLICATIONS

The present application claims the priority of Chinese Patent Application No. 201810942914.8, filed on Aug. 17, 2018, the content of which is incorporated herein by reference.

BACKGROUND OF THE INVENTION

1. Field of the Invention

The present invention relates to an electrical connector, and more particularly to an electrical connector a better structural efficiency and retention.

2. Description of Related Art

A traditional electrical connector mainly comprises at least one contact and an insulative housing holding the contact in isolation from others. However, the contact in the traditional electrical connector is retained in the insulative housing via a barb thereof, and the insulative housing defines a locking slot for latching with the barb, thus the insulative housing has a weak structure, and the contact is fixed in the insulative housing only by the barb, the retaining force between the contact and the insulative housing is insufficient.

Hence, it is desired to provide an electrical connector to overcome the problems mentioned above.

BRIEF SUMMARY OF THE INVENTION

Accordingly, an object of the present invention is to provide an electrical connector with a better structural efficiency and retention.

The present invention is directed to an electrical connector comprising an insulative housing, a plurality of contacts and a fastener, the insulative housing has a plurality of contact-receiving passageways extending through thereof along a front-and-back direction and a positioning slot recessed upwards from a bottom face thereof, the positioning slot is extending along a transverse direction of the insulative housing and communicated with the contact-receiving passageways. The contacts are retained in the corresponding contact-receiving passageways of the insulative housing. The fastener is assembled into the positioning slot along a down-to-up direction before the contacts being inserted into the insulative housing, and defines a plurality of receiving channels correspondingly arranged with the contact-receiving passageways. Each contact defines a stopping portion and an elastic locking arm disposed on opposite sides thereof in a height direction, the locking arm extends backwards to form a free end at the back, the contacts are inserted into the relative contact-receiving passageways and the receiving channels along a back-to-front direction, and the free ends of the locking arms are locking with the insulative housing to realize a pre-position between the contacts and the housing, after the contacts assembled into the insulative housing, the fastener is pressed upwards into the positioning slot fully and abutting against a rear end of the stopping portion to form a secondary positioning.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
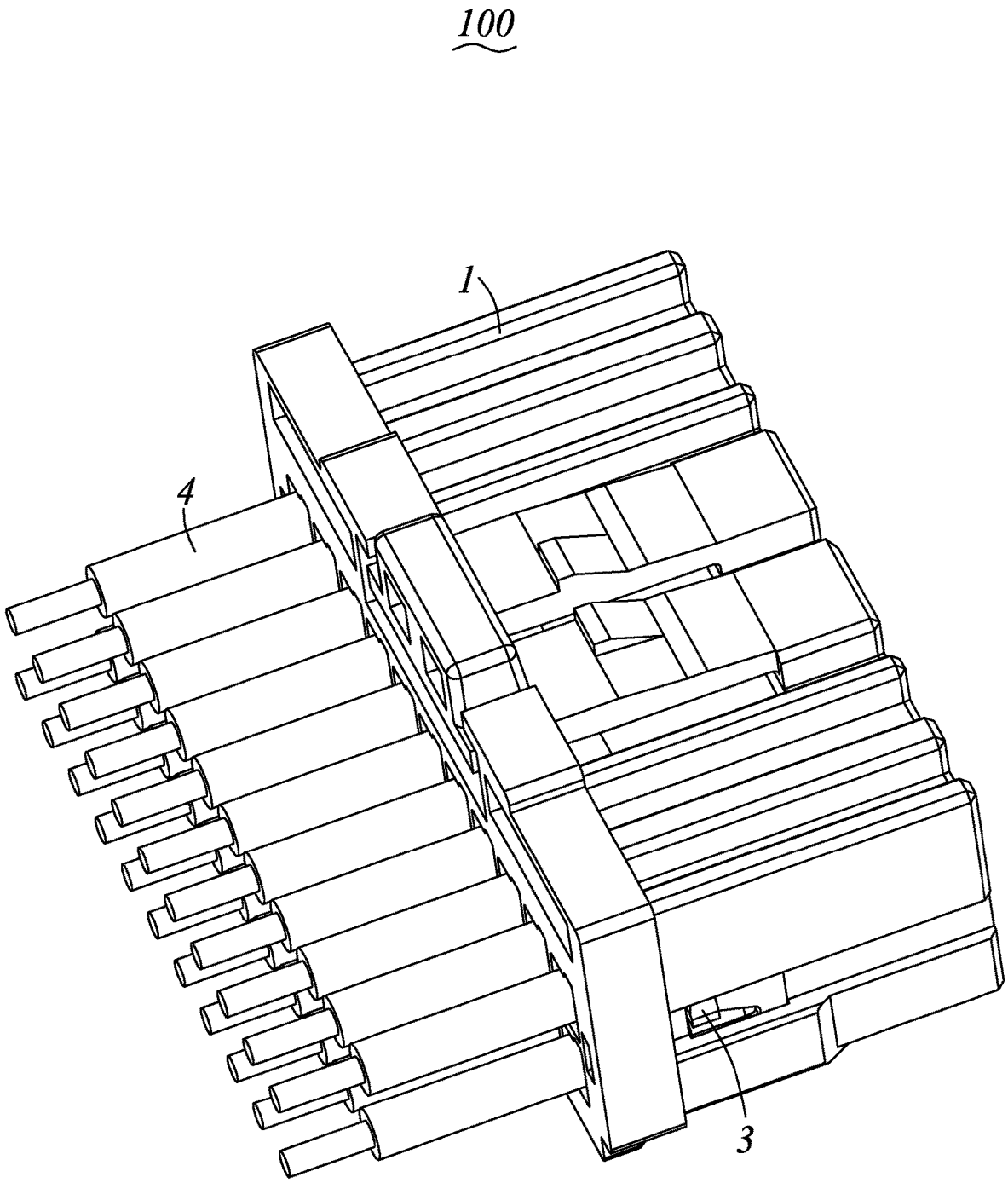
FIG. 1 is a perspective view of an electrical connector in accordance with the present invention.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-11 illustrate an electrical connector 100 according to the present invention, and the electrical connector 100 comprises an insulative housing 1, a plurality of contacts 2 held in the insulative housing 1, a fastener 3 assembled to the insulative housing 1 and a number of wires 4 mechanically and electrically connected with the corresponding contacts 2.

Figure 9:
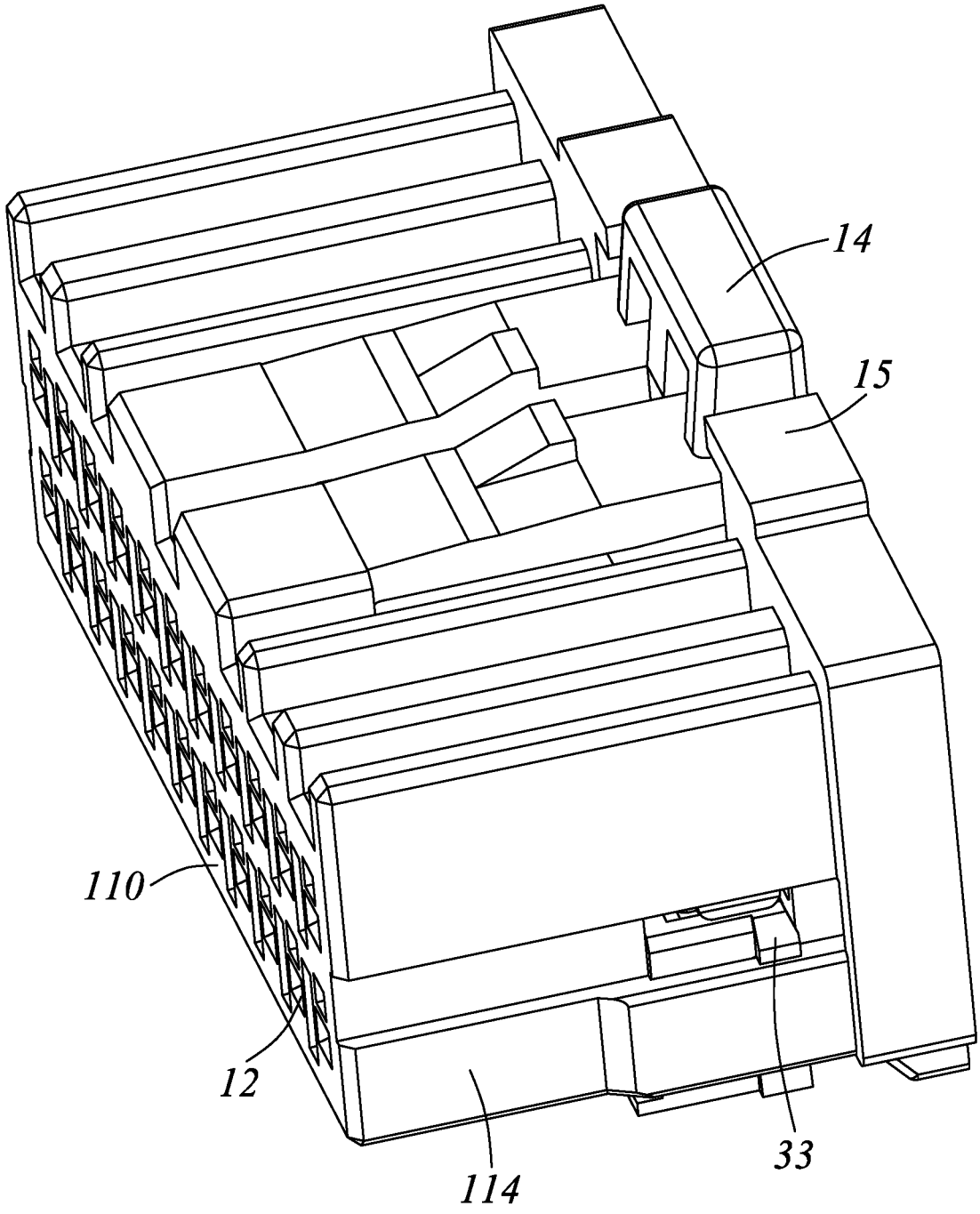
FIG. 9 is an assembled view of the electrical connector shown in FIG. 3.
Figure 10:
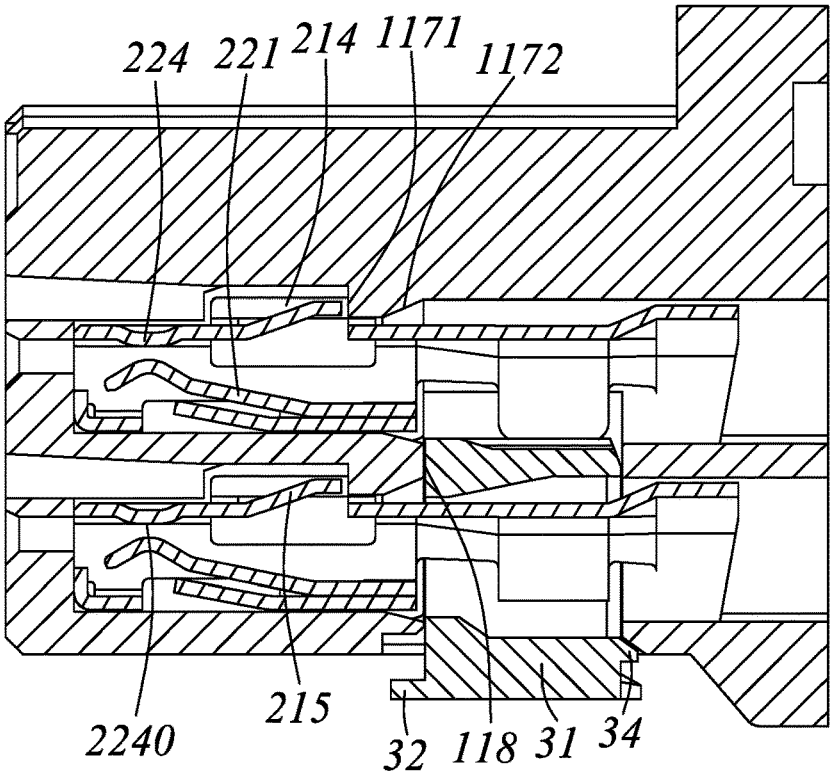
FIG. 10 is a sectional view of the electrical connector shown in FIG. 9.
Figure 11:
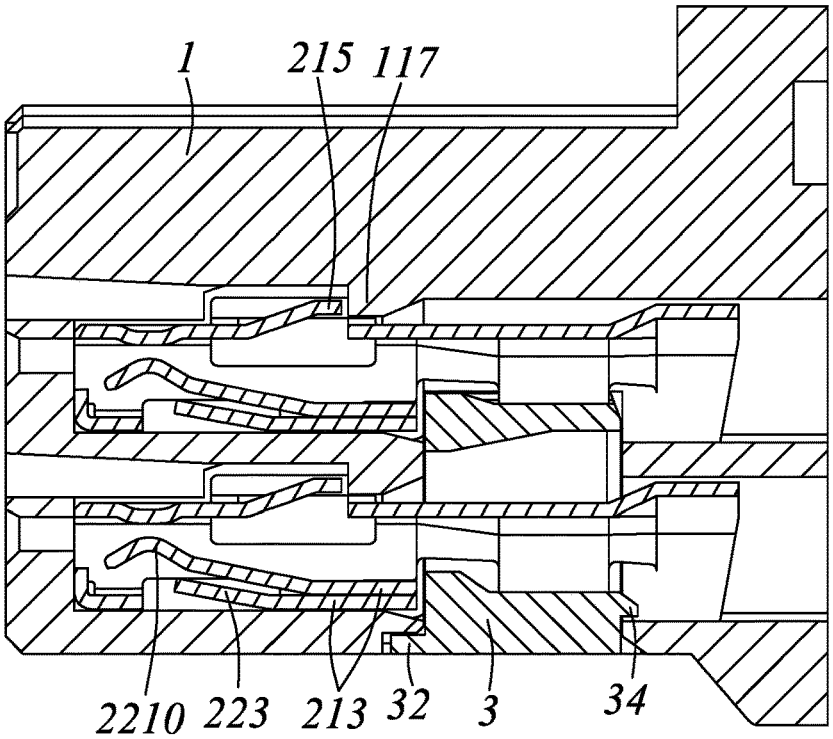
FIG. 11 is a cross-section view of the electrical connector when the fastener is completely pressed into a positioning slot of the insulative housing.

Referring to FIGS. 1 to 4, and conjunction with FIGS. 9 to 11, the insulative housing 1 has a plurality of contact-receiving passageways 12 extending through thereof along a front-and-back direction and a positioning slot 13 recessed upwards from a bottom face thereof. Specifically, the insulative housing 1 defines a main portion 11, the contact-receiving passageways 12 are extending through the main portion 11 along the front-and-back direction, the positioning slot 13 is recessed upwards from a bottom face of the main portion 11. In the illustrated embodiment, the contact-receiving passageways 12 are divided into an upper row and a lower row, the upper row of contact-receiving passageways 12 are aligning with the lower row of contact-receiving passageways 12 in a one-to-one correspondence along a height direction.

The positioning slot 13 is extending along a transverse direction of the insulative housing 1 and communicated with the contact-receiving passageways 12, the contacts 2 is retained in the corresponding contact-receiving passageways 12. The fastener 3 is assembled into the positioning slot 13 along a down-to-up direction before the contacts 2 being inserted into the insulative housing 1, and has a plurality of receiving channels 30 correspondingly arranged with the contact-receiving passageways 12.

The main portion 11 defines an upper wall 112, a lower wall 113 opposite to the upper wall 112 and a pair of side walls 114, the sides walls 114 are connecting the upper wall 112 with the lower wall 113, the positioning slot 13 is disposed in the lower wall 113 of the insulative housing 1. The insulative housing 1 further has a pair of latching grooves 116 on relative side walls 114, and each latching groove 116 is recessed inwards from an outer surface of the relative side wall 114 and penetrating through the relative side wall 114, the latching grooves 116 are communicated with the positioning slot 13. The positioning slot 13 is formed by recessing upwards from a bottom face of the lower wall 113, and the latching grooves 116 are arranged symmetrically on both sides of the insulative housing 1.

The main portion 11 further has a plurality of bulges 117 corresponding to the contact-receiving passageways 12 in one-to-one correspondence, and each bulge 117 is protruding downwards in the relative contact-receiving passageway 12.

The insulative housing 1 defines an elastic latching arm 14 on an upper side of the main portion 11, and the latching arm 14 has a rear free end which can move along the height direction under an external pressure. A pair of limiting walls 15 are defined on a top side of the insulative housing 1 and neighboring to a rear surface of the insulative housing 1, to prevent the latching arm 14 moving upwards overly. The pair of limiting walls 15 are spaced apart from each other along the transverse direction and located on both sides of the latching arm 14. In further, the pair of limiting walls 15 are arranged above corresponding shoulders 141 of the latching arm 14, to prevent the latching arm 14 from being overturned during plugging or unplugging with a complementary connector (not shown).

Figure 2:
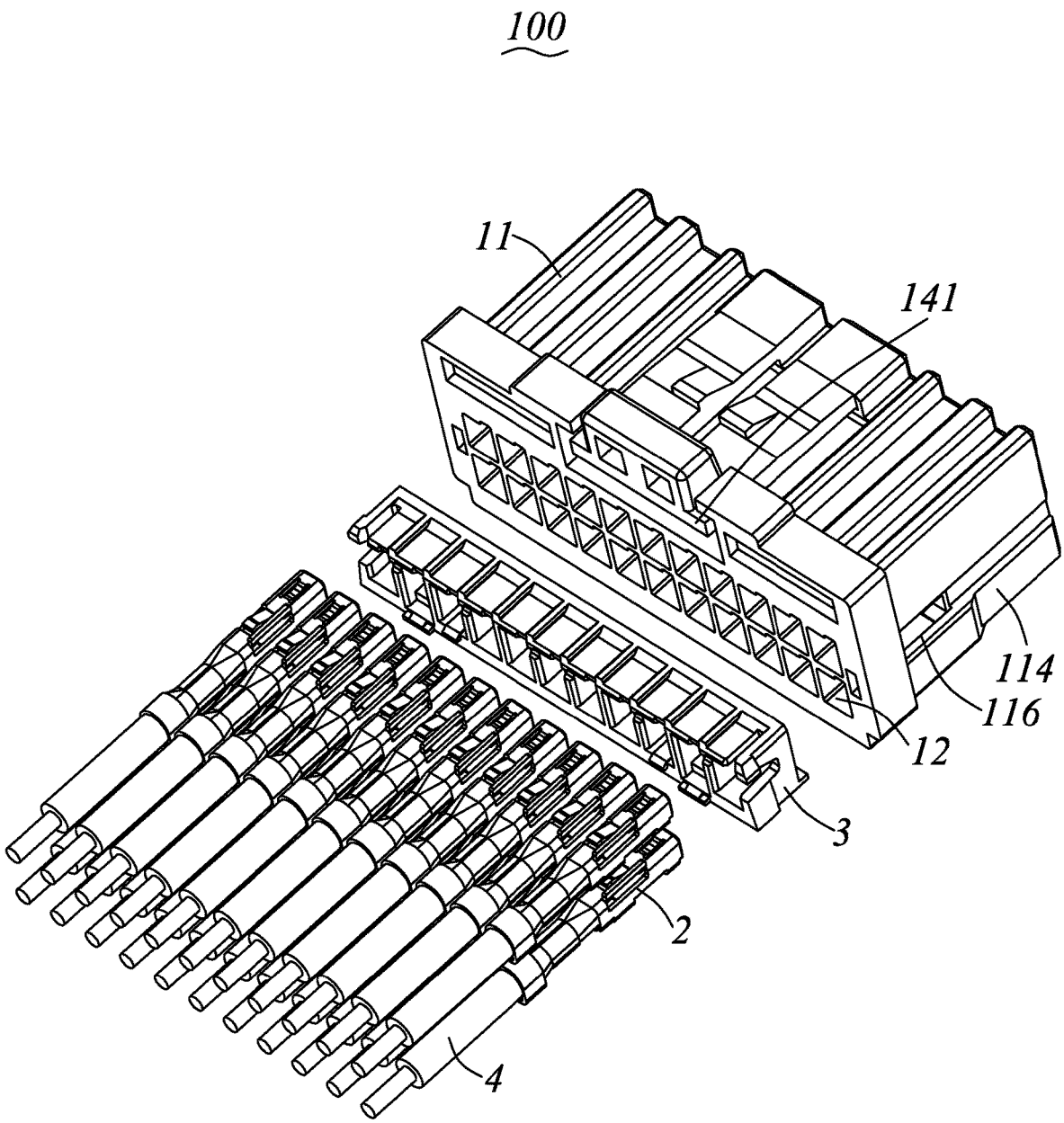
FIG. 2 is an exploded view of the electrical connector shown in FIG. 1.
Figure 3:
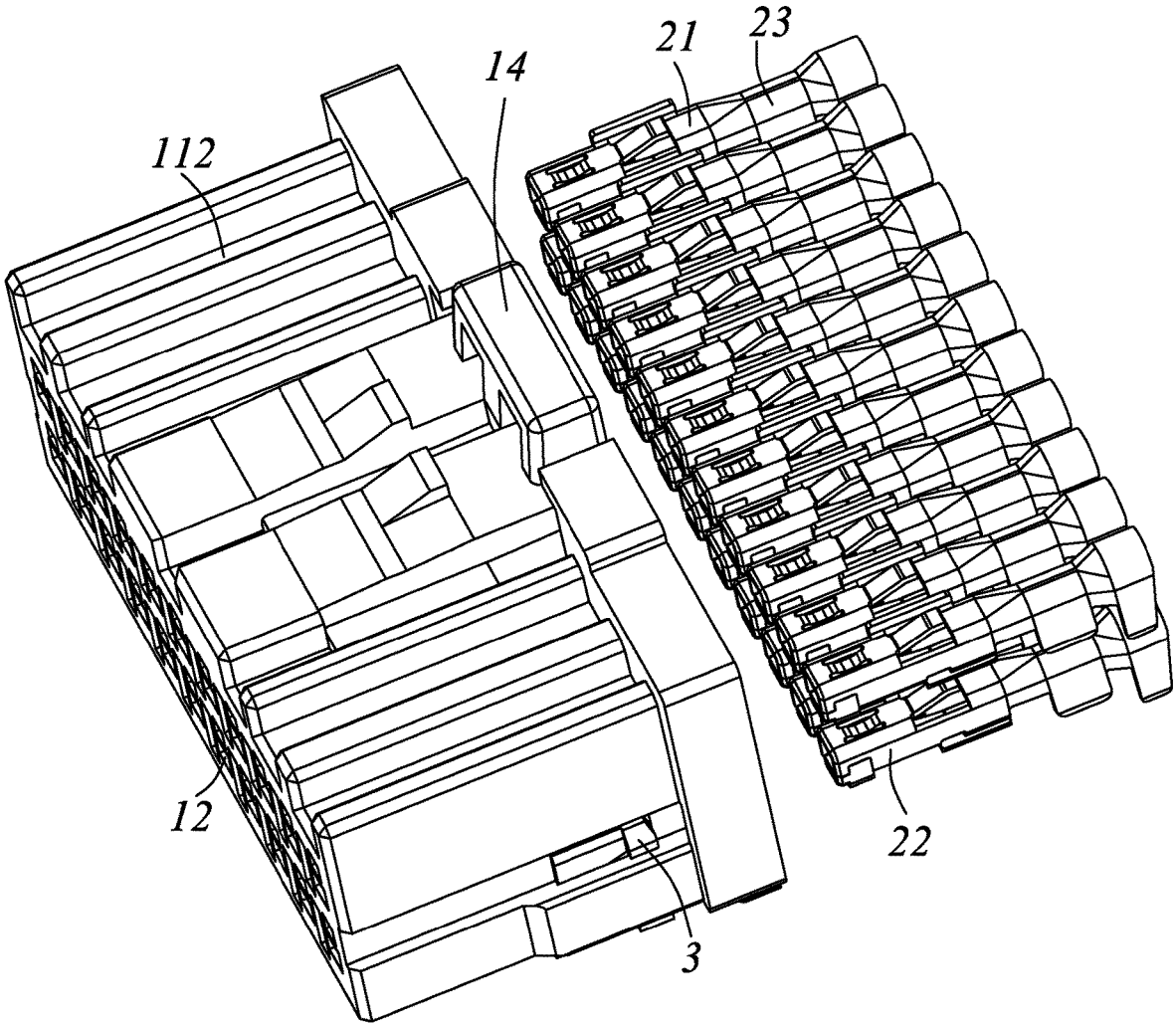
FIG. 3 is a partial assembled view of the electrical connector shown in FIG. 2 without wires.
Figure 4:
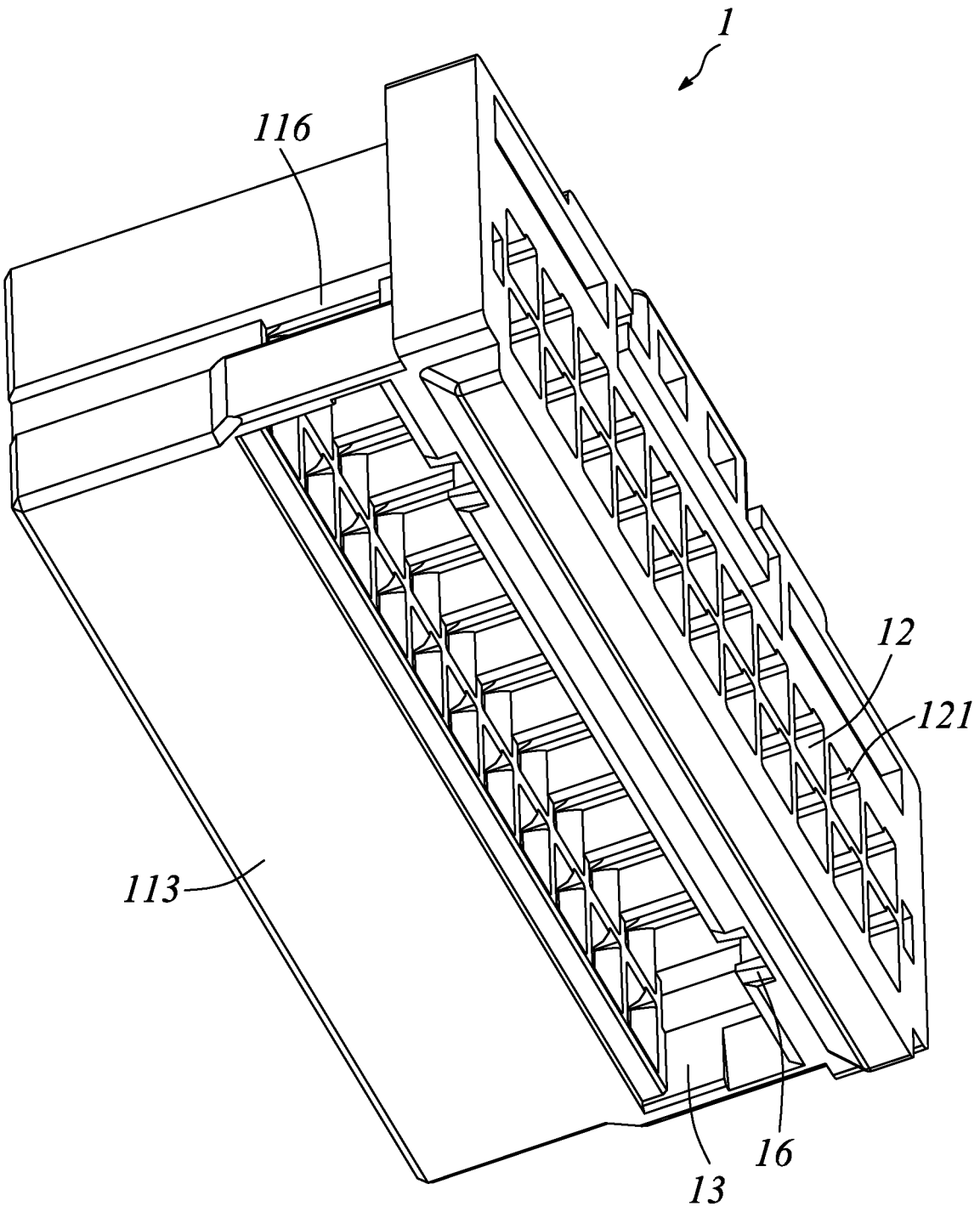
FIG. 4 is a perspective view of an insulative housing of the electrical connector shown in FIG. 1.

Referring to FIGS. 2 and 4, viewed from the rear surface of the insulative housing 1, in the height direction, each contact-receiving passageway 12 has a guiding slot 121 with an increased height, and the guiding slot 121 is defined on one side of the contact-receiving passageway 12 along the transverse direction and extending towards the opposite side. Furthermore, the guiding slots 121 extend along the transverse direction with unlimited widths.

Referring to FIGS. 2, 3, 7, 8, and conjunction with FIGS. 10-11, the contacts 2 are assembled into the corresponding contact-receiving passageways 12 along a back-to-front direction, and arranged at least one row in which the contacts 2 juxtaposed along the transverse direction. In the illustrated embodiment as shown, the contacts 2 are divided into two rows in the height direction, and the contacts 2 in each row are arranged abreast in the transverse direction. In other embodiments, the contacts 2 also can be arranged in three rows or more along the height direction.

Each contact 2 has a primary segment 21, a contacting segment 22 in front of the primary segment 21 and a crimping segment 23 behind the primary segment 21 for connecting with the relative wire 4, and the contacting segment 22 of each contact 2 defines a mating cavity 20 for a complementary contact (not shown) plugging into.

In the illustrated embodiment, the primary segment 21 is provided with a top wall 211, a pair of lateral portions 212 on both sides of the top wall 211 in the transverse direction and a pair of plate portions 213 integrally connecting with the corresponding lateral portions 212, the plate portions 213 are extending from lower ends of the relative lateral portions 212 towards each other. Further, in this embodiment, the pair of plate portions 213 are stacked with each other in the height direction to jointly form a stopping portion; and in other embodiments, the stopping portion also can be formed by other structures located on a bottom side of the lateral portions 212.

The primary segment 21 defines a leading portion 214 protruding along the height direction and an elastic locking arm 215 extending towards the crimping segment 23. The stopping portion and the locking arm 215 are disposed on opposite sides of the contact 2 in the height direction. The leading portion 214 is defined on one side of the locking arm 215 along the transverse direction, and bending upwards from the top wall 211. Each leading portion 214 is inserted from the corresponding side (that is a side the guiding slot 121 is defined on) of the contact-receiving passageway 12 into the guiding slot 121 of the insulative housing 1. In this embodiment, the leading portion 214 is formed by tearing and bending upwards from one of the lateral portion 212; in other embodiments, the leading portion 214 also can be formed in other ways.

Referring to FIGS. 10 to 11, in the height direction, an upper end surface of the leading portion 214 is higher than a top face of the locking arm 215, and in the front-and-back direction, a rear surface of the locking arm 215 is in front of a rear face of the leading portion 214, therefore, when a downward or forward external force is exerted on each contact 2, the locking arm 215 can be protected by the leading portion 214, to prevent the external force directly exerting on the locking arm 215. In addition, when the contacts 2 are not inserted into the insulative housing 1 and placed intensively, the leading portions 214 can avoid the damage caused by the hooking of two neighboring locking arms 215.

The locking arm 215 extends upwards and backwards to form a free end at the back, the contacts 2 are inserted into the relative contact-receiving passageways 12 and the receiving channels 30 along the back-to-front direction, and the locking arms 215 are locking with the insulative housing 1 to realize a pre-position between the contacts 2 and the housing 1. Specifically, each bulge 117 is abutting against the free end of the corresponding locking arm 215 from a rear side of the locking arm 215, thus each contact 2 is preliminary positioned in the insulative housing 1. After the contacts 2 assembled into the insulative housing 1, the fastener 3 is pressed upwards into the positioning slot 13 fully and abutting against a rear end of the stopping portion to form a secondary positioning. In further, each bulge 117 has a front resisting face 1171 abutting against the free end of corresponding locking arm 215 and a rear guiding face 1172 for leading corresponding contact 2 being inserted forwardly.

The contacting segment 22 has a contacting arm 221 for mating with the complementary contact, the contacting arm 221 and the locking arm 215 are extending along reverse directions. In this embodiment, the contacting arm 221 is extending forwards from the plate portion 213 into the mating cavity 20, specifically, the contacting arm 221 is extending forwards from an upper one of the pair of plate portions 213. And the contacting arm 221 has a free end at the front thereof and extends obliquely upward, thus a resilient contact of the contacting arm 221 is realized. The contacting arm 221 is provided with a curved first contacting portion 2210 close to the free end thereof and protruding upwards.

The contacting segment 22 further defines a contacting beam 224 on the top wall 211, and the contacting beam 224 is protruding towards the mating cavity 20. Both a front end and a rear end of the contacting beam 224 are connecting with the top wall 211, and the contacting beam 224 defines a second contacting portion 2240 protruding towards the first contacting portion 2210. The second contacting portion 2240 and the first contacting portion 2210 are protruding towards and opposite to each other, to achieve a reliable double-sided contact with the complementary contact, and a reliability of electrical connection during mating can be increased.

Each contact 2 further has a protecting arm 223 on an exterior side of the contacting arm 221, and the protecting arm 223 is extending forwards from the plate portion 213 on a lower side of the pair of plate portions 213.

A cutout 24 is formed in a conjoining area between the primary segment 21 and the contacting segment 22, and the locking arm 215 is located in the cutout 24 in the front-and-back direction.

Figure 5:
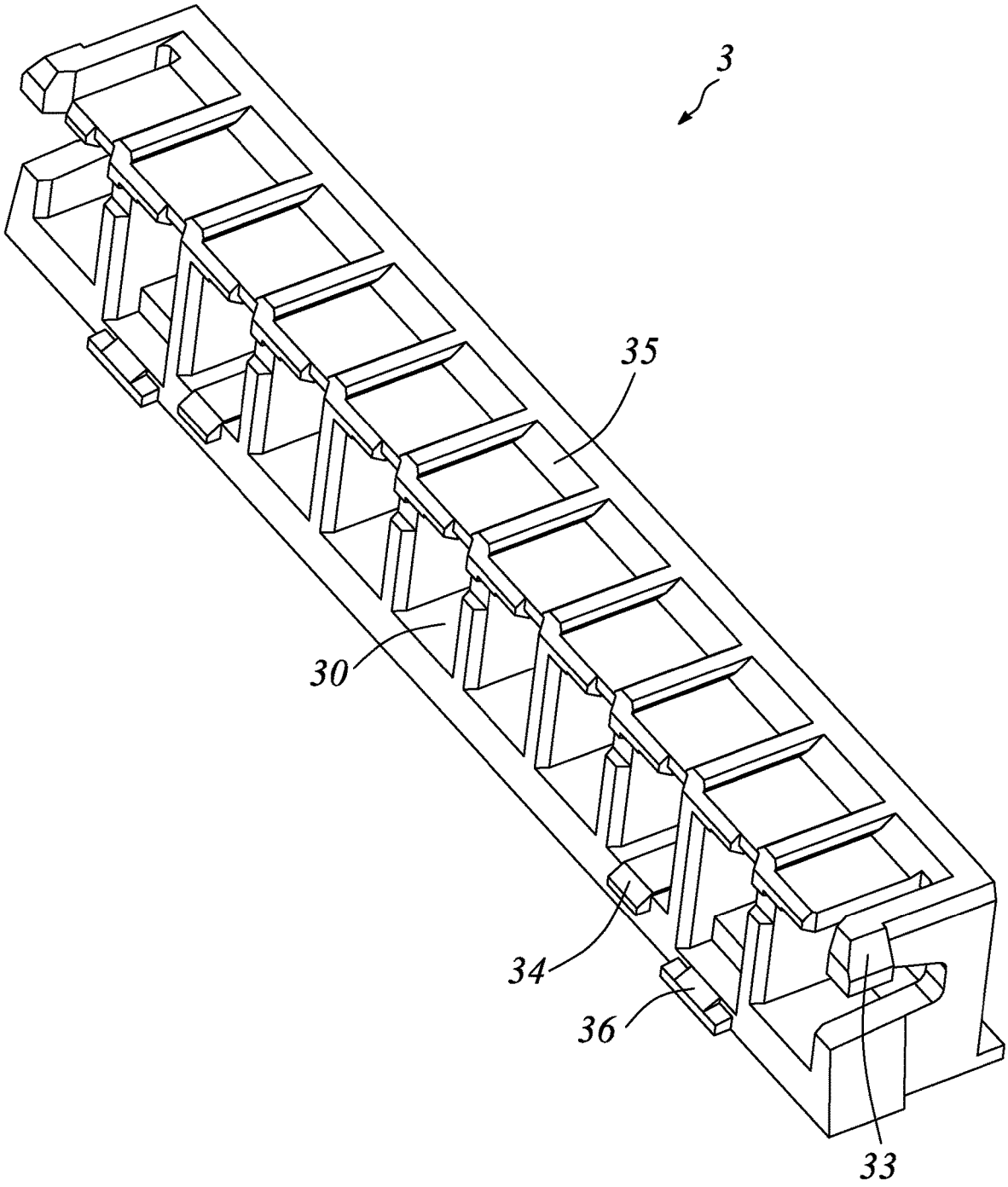
FIG. 5 is a perspective view of a fastener of the electrical connector shown in FIG. 2.
Figure 6:
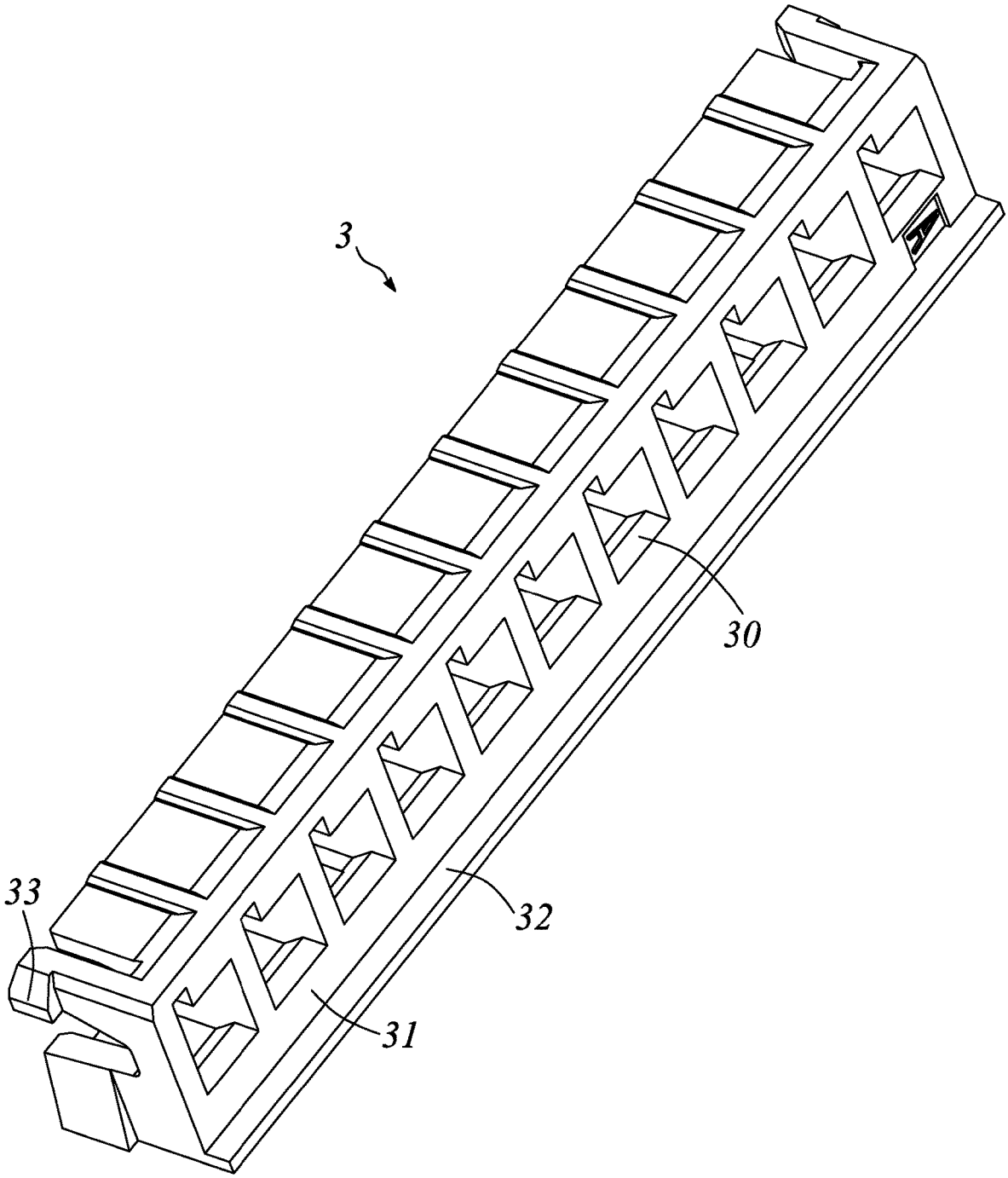
FIG. 6 is similar to FIG. 5, but viewed from a different angle.
Figure 7:
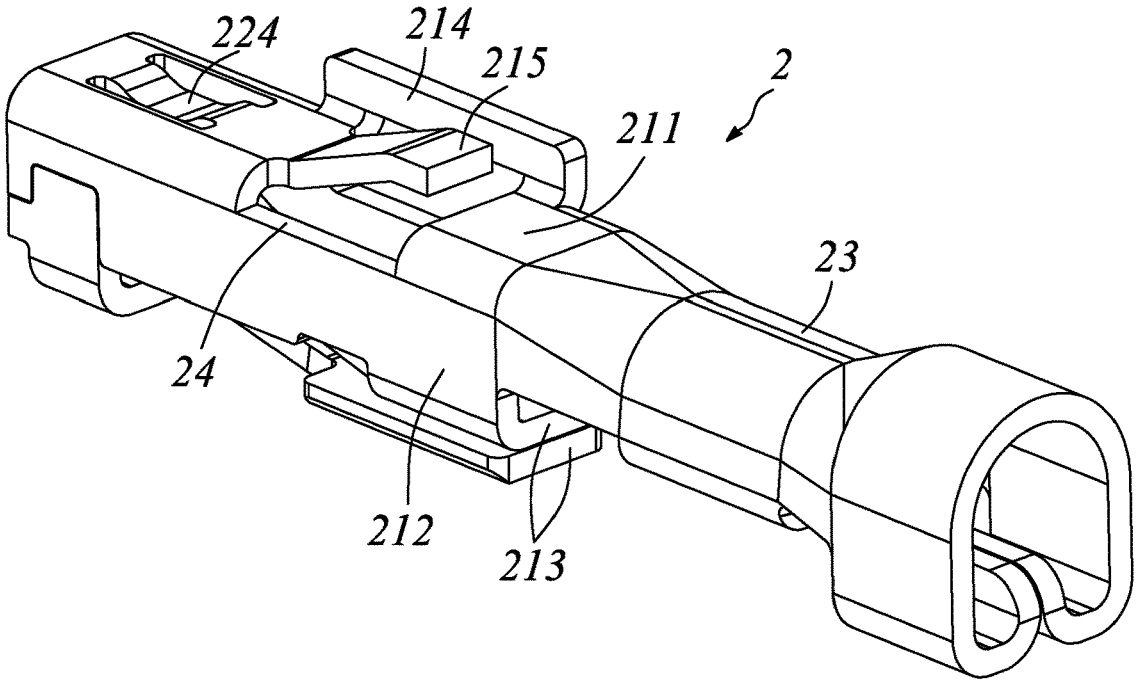
FIG. 7 is a perspective view of a contact of the electrical connector shown in FIG. 2.
Figure 8:
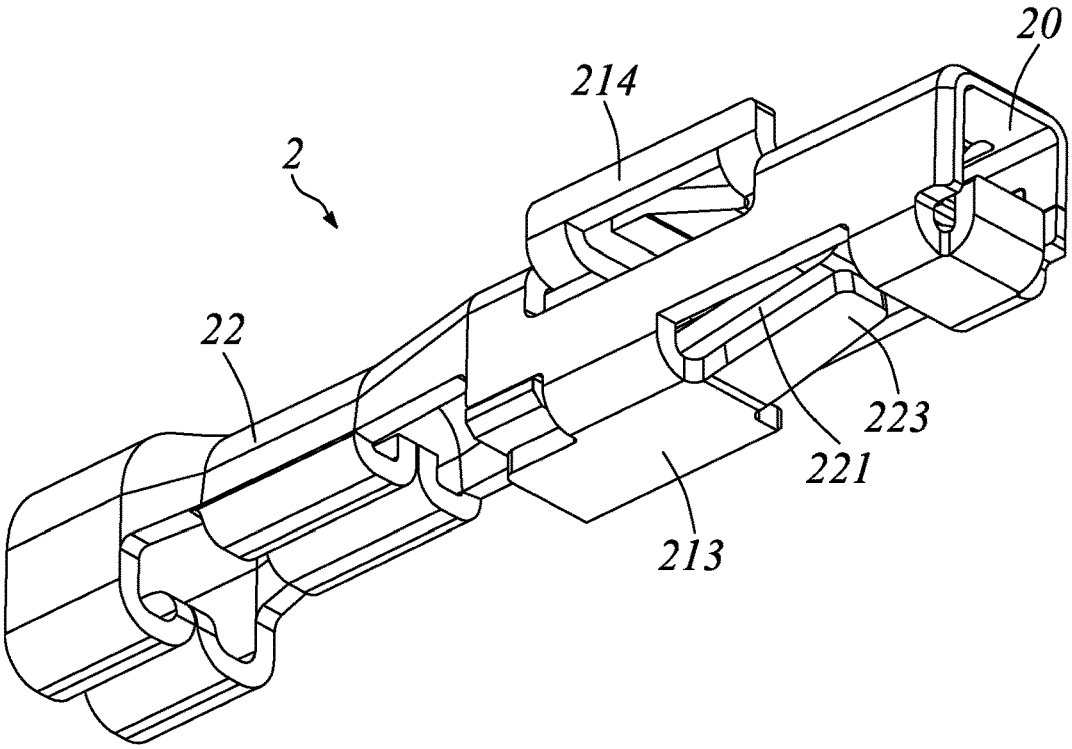
FIG. 8 is similar to FIG. 7, but shown from a different aspect.

Referring to FIGS. 5 to 6, and conjunction with FIGS. 10 to 11, the fastener 3 comprises a base portion 31, a flange 32 neighboring to a bottom side thereof, a pair of first locking tabs 33 on both sides thereof in a transverse direction and at least a second locking tabs 34 on a rear side thereof. The flange 32 is extending forwards from a front end of the base portion 31, and the second locking tabs 34 is protruding backwards from a rear face of the base portion 31.

The fastener 3 further defines a front wall 35 in the front thereof and at least one limiting block 36 protruding backwards from the rear face of the base portion 31, the front wall 35 is protruding upwards, and a front surface of the front wall 35 is behind the stopping portion and abutting against a restricting face 118 in the insulative housing 1. In this embodiment, the fastener 3 has a pair of limiting blocks 36 spaced apart from each other along the transverse direction, and in the transverse direction, the limiting blocks 36 and the second locking tabs 34 are stagger with each other, the pair of the second locking tabs 34 are disposed between the pair of limiting blocks 36. The insulative housing 1 defines a pair of limiting slots 16 recessed upwards from the bottom face thereof, and the limiting slots 16 are communicated with the positioning slot 13 to receive the corresponding limiting blocks 36.

Before the contacts 2 inserted into the insulative housing 1, the fastener 3 is positioned in the insulative housing 1 via the first locking tabs 33, and after the contacts 2 inserted into the insulative housing 1, the fastener 3 is positioned in the insulative housing 1 via the second locking tabs 34.

In particular, before the contacts 2 assembled into the insulative housing 1, the fastener 3 is preassembled into the positioning slot 13 along the down-to-up direction, and the first locking tabs 33 are inserted and fixed in the latching grooves 116 on both sides of the insulative housing 1 to prevent moving downwards (as shown in FIG. 10), the second locking tabs are located on a bottom side of the relative contact-receiving passageways 12, and FIGS. 9-10 illustrate a status of the fastener 3 preassembled into the insulative housing 1. After the contacts 2 assembled into the insulative housing 1, the fastener 3 moves upwards under an upward pressure until the second locking tabs 34 enters and is fixed in the corresponding contact-receiving passageways 12 (as shown in FIG. 11).

The fastener 3 of the electrical connector 100 is preassembled into the insulative housing 1 before the contacts 2 assembled into the insulative housing 1, to prevent the fastener 3 being lost. While the contacts 2 assembled to the insulative housing 1, the pre-position between the contacts 2 and the housing 1 is achieved by the locking arms 215. After the contacts 2 fully assembled into the insulative housing 1, the fastener 3 is pressed upwards into the positioning slot 13 completely, and the second locking tabs 34 are engaging with the relative contact-receiving passageways 12 to make the fattener 3 be fixed in the positioning slot 13, the fastener 3 is abutting against the rear end of the stopping portion of each contact 2 to form a secondary positioning. Therefore, a structural efficiency of the insulative housing 1 and a retaining force between the contacts 2 and the insulative housing 1 can be increased, thereby the reliability and stability of electrical connection are enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a plurality of contact-receiving passageways extending through thereof along a front-and-back direction and a positioning slot recessed upwards from a bottom face thereof, the positioning slot extending along a transverse direction of the insulative housing and communicated with the contact-receiving passageways;

a plurality of contacts retained in the corresponding contact-receiving passageways of the insulative housing; and a fastener assembled into the positioning slot along a down-to-up direction before the contacts being inserted into the insulative housing, and defining a plurality of receiving channels correspondingly arranged with the contact-receiving passageways; wherein each contact defines a stopping portion and an elastic locking arm disposed on opposite sides thereof in a height direction, the locking arm extends backwards to form a free end at the back, the contacts are inserted into the relative contact-receiving passageways and the receiving channels along a back-to-front direction, and the free ends of the locking arms are locking with the insulative housing to realize a pre-position between the contacts and the insulative housing and prevent contacts backoff, after the contacts assembled into the insulative housing, the fastener is pressed upwards into the positioning slot fully and abutting against a rear end of the stopping portion to form a secondary positioning, each contact has a primary segment and a contacting segment in front of the primary segment, and the primary segment is provided with a top wall, a pair of lateral portions on both sides of the top wall in the transverse direction and a pair of plate portions integrally connecting with the corresponding lateral portions, the plate portions are extending from lower ends of the relative lateral portions towards each other and stacked with each other in the height direction to jointly form the stopping portion.

2. The electrical connector as claimed in claim 1, wherein each contact further has a crimping segment behind the primary segment.

3. The electrical connector as claimed in claim 1, wherein each contact further defines a contacting arm for mating with a complementary contact, the contacting arm and the locking arm are extending along reverse directions.

4. The electrical connector as claimed in claim 3, wherein the contacting segment of each contact defines a mating cavity for the complementary contact plugging into, the contacting arm is extending forwards from the plate portion on an upper side of the pair of plate portions into the mating cavity.

5. The electrical connector as claimed in claim 4, wherein each contact further has a protecting arm on an exterior side of the contacting arm, and the protecting arm is extending forwards from the plate portion on a lower side of the pair of plate portions.

6. The electrical connector as claimed in claim 2, wherein a cutout is formed in a conjoining area between the primary segment and the contacting segment, and the locking arm is located in the cutout in the front-and-back direction.

7. The electrical connector as claimed in claim 6, wherein each contact further has a leading portion on one side of the locking arm along the transverse direction, the leading portion is bending upwards from the top wall and inserted into a guiding slot of the insulative housing.

8. The electrical connector as claimed in claim 2, wherein the insulative housing further has a plurality of bulges corresponding to the contact-receiving passageways in one-to-one correspondence, and each bulge is protruding downwards in the relative contact-receiving passageway for abutting against the free end of the corresponding locking arm from a rear side of the locking arm.

9. The electrical connector as claimed in claim 8, wherein the fastener further defines a front wall in the front thereof, the front wall is protruding upwards, and a front surface of the front wall is behind the stopping portion and abutting against a restricting face in the insulative housing.

10. The electrical connector as claimed in claim 1, wherein the fastener has a pair of first locking tabs on both sides thereof in a transverse direction and at least a second locking tab on a rear side thereof, and before the contacts inserted into the insulative housing, the fastener is positioned in the insulative housing via the first locking tabs, after the contacts inserted into the insulative housing, the fastener is positioned in the insulative housing via the second locking tabs.

11. The electrical connector as claimed in claim 10, wherein before the contacts assembled into the insulative housing, the fastener is preassembled into the positioning slot along the down-to-up direction, and the first locking tabs are inserted and fixed in latching grooves on both sides of the insulative housing to prevent moving downwards, the second locking tabs are located on a bottom side of the relative contact-receiving passageways.

12. The electrical connector as claimed in claim 11, wherein after the contacts assembled into the insulative housing, the fastener moves upwards under an upward pressure until the second locking tabs enters and is fixed in the corresponding contact-receiving passageways.

13. An electrical connector, comprising:

an insulative housing having a plurality of contact-receiving passageways extending through thereof along a front-and-back direction and a positioning slot recessed upwards from a bottom face thereof, the positioning slot extending along a transverse direction of the insulative housing and communicated with the contact-receiving passageways;

a plurality of contacts retained in the corresponding contact-receiving passageways of the insulative housing; and a fastener assembled into the positioning slot along a down-to-up direction before the contacts being inserted into the insulative housing, and defining a plurality of receiving channels correspondingly arranged with the contact-receiving passageways; wherein each contact defines a stopping portion and an elastic locking arm disposed on opposite sides thereof in a height direction, the locking arm extends backwards to form a free end at the back, the insulative housing further has a plurality of bulges corresponding to the contact-receiving passageways in one-to-one correspondence, the contacts are inserted into the relative contact-receiving passageways and the receiving channels along a back-to-front direction, and the free ends of the locking arms are locking with corresponding bulges to realize a pre-position between the contacts and the insulative housing, each bulge is protruding downwards in the relative contact-receiving passageway for abutting against the free end of corresponding locking arm from a rear side of the locking arm to prevent contacts backoff, after the contacts assembled into the insulative housing, the fastener is pressed upwards into the positioning slot fully and abutting against a rear end of the stopping portion to form a secondary positioning.

14. The electrical connector as claimed in claim 13, wherein each bulge has a front resisting face abutting against the free end of corresponding locking arm and a rear guiding face for leading corresponding contact being inserted forwardly.

15. The electrical connector as claimed in claim 14, wherein the contacts are divided into two rows in the height direction, and the contacts in each row are arranged abreast in the transverse direction, the fastener is pressed upwards into the positioning slot fully and holding two rows of the contacts in the insulative housing.

* * * * *